US005692631A

United States Patent [19]

Tillard et al.

[11] Patent Number: 5,692,631

[45] Date of Patent: Dec. 2, 1997

[54] CONTAINER FOR TRANSPORTING, STORING AND DISPENSING CHEMICAL PRODUCTS

[75] Inventors: Marie-Anne Tillard, Paris; Christian Colin, Langres, both of France; Werner Buttner, Darmstadt, Germany; Winfried Trinkaus, Dieburg, Germany; Martin Benzinger, Michelstadt, Germany

[73] Assignee: Compagnie Plastic Omnium, Lyons, France

[21] Appl. No.: 697,636

[22] Filed: Aug. 29, 1996

Related U.S. Application Data

[63] Continuation of Ser. No. 258,742, Jun. 10, 1994, abandoned.

[30] Foreign Application Priority Data

Jun. 11, 1993 [FR] France ..... 93 07082

[51] Int. Cl.[6] ..... B65D 7/00

[52] U.S. Cl. ..... 220/4.12; 220/1.5; 220/4.13

[58] Field of Search ..... 220/4.12, 1.5, 220/4.13, 403

[56] References Cited

U.S. PATENT DOCUMENTS

| | | | |
|---|---|---|---|
| 929,842 | 8/1909 | Eckart | 220/521 |
| 3,571,533 | 3/1971 | Coleman | 220/4.12 |
| 3,814,290 | 6/1974 | Gerhard | 220/4.12 X |
| 4,516,693 | 5/1985 | Gaston . | |
| 4,782,973 | 11/1988 | Wiese | 220/4.12 X |
| 4,793,491 | 12/1988 | Wolf et al. | 220/4.12 X |
| 4,807,777 | 2/1989 | Berwald et al. | 220/1.5 X |
| 4,961,509 | 10/1990 | Currier | 220/4.12 X |

FOREIGN PATENT DOCUMENTS

| | | |
|---|---|---|
| 0484771 | 10/1991 | European Pat. Off. . |
| 3913643 | 4/1989 | Germany . |
| 8803899 | 6/1988 | WIPO . |

*Primary Examiner*—Steven M. Pollard

*Attorney, Agent, or Firm*—Schweitzer Cornman Gross & Bondell LLP

[57] ABSTRACT

Container for transporting, storing and dispensing chemical products, including an inner shell made of fluoroplastic, particularly PFA, fitted at its upper part with a stopper device traversed by filling and dispensing connections, and an outer shell exhibiting a substantially cylindrical outer shape and an inner shape substantially matching that of the inner shell.

The outer shell (1) is made up of a cylindrical part (6) which, at its lower part, is integral with a base (7) of quadrilateral cross-section and of greater cross-sectional area than that of the cylindrical part of the outer shell.

8 Claims, 1 Drawing Sheet

CONTAINER FOR TRANSPORTING, STORING AND DISPENSING CHEMICAL PRODUCTS

This is a continuing application of U.S. Ser. No. 08/258,742, filed Jun. 10, 1994, now abandoned.

BACKGROUND OF THE INVENTION

The subject of the present invention is a container for transporting, storing and dispensing chemical products, particularly chemical products with a very high degree of purity such as those intended for the semiconductor industry.

Containers have recently been developed which are compatible with this use and which include an inner shell made of fluoroplastic, particularly PFA (perfluoroalkoxy copolymer), fitted at its upper part with a stopper device traversed by filling and dispensing connections, and an outer shell exhibiting a substantially cylindrical outer shape and an inner shape substantially matching that of the inner shell.

An example of such a container is indicated in FR-A-2,628,074.

In the container according to this prior document, the outer shell, which is preferably a double-walled shell made of polyethylene lined with a foam, is cylindrical over the entire height of the container.

Such a design makes the container relatively sensitive to lateral impacts, particularly during transportation and during use, particularly at the lower part of the container via which the latter is made to knock against the ground or the surfaces of means of transport. The nature of such impacts is such as to damage the inner shell and/or the connections with which the stopper device of the latter is fitted.

SUMMARY OF THE INVENTION

The present invention proposes to produce a container for transporting, storing and dispensing chemical products, which can be pressurized and demounted and which affords optimum resistance to impacts, particularly at the top part and bottom part of the container, which impacts might lead to deterioration of the inner shell and/or of the connections of the stopper device.

According to a first characteristic of the present invention, the outer shell includes a cylindrical part which, at its lower part, is integral with a base of quadrilateral cross-section and of greater cross-sectional area than that of the cylindrical part of the outer shell.

This base, which is square or preferably rectangular and which may be fitted with feet at its lower part, affords the container excellent stability on the ground, the parts overhanging the base constituting a shield for protection against impacts.

The base also constitutes a transport pallet, the container thus constituting a structure which can be transported in one piece.

According to another characteristic of the present invention, the outer shell is surmounted by an annular lid for the peripheral protection of the connections with which the stopper device is fitted, the said lid being made up of a plurality of bosses separated from each other by slits with a bottom wall inclined downwards and outwards. The lid advantageously exhibits a frustoconical overall shape, the bosses being segments of a cone frustum.

The segments constituting the lid which are located around the central part of the container from which the connections of the stopper device extend upwards, exhibit a height greater than that of the connections and constitute, in the corresponding zone, a shield against lateral impacts to which the container might be subjected and which might damage the connections projecting from the stopper device.

The slits produced between the segments of the lid facilitate access to the connections by the users, it being possible for the latter to insert their arm right up to the stopper device equipped with the connections without being hindered by the height of the lid.

The outwardly sloping slits also promote the runoff of water after the outer shell of the container has been cleaned with water jets before use. The passages thus produced prevent the water from stagnating on the upper part of the container.

The specific shape of the lid according to the present invention also avoids disturbance of the vertical laminar flow of clean air used when connecting the container.

The laminar flow can run off from the top of the connections towards the base of the latter and be removed without a high degree of turbulance, via the slits formed between the segments of the lid.

According to another characteristic of the present invention, in order to afford, even in the event of impacts, particularly satisfactory sealing of the stopper device at the upper end of the inner shell, the stopper device is fixed to a collar provided at the upper part of the inner shell by fixing members, such as studs made of composite materials, and exhibits a frustoconical lower extension capable of being housed in the said collar which for this purpose includes an inner wall of corresponding frustoconical shape.

This embodiment makes it possible to dispense with any elastomer seal between the stopper device and the inner shell which, in conventional containers, is a source of pollution for the products transported because it does not exhibit the chemically inert characteristics of fluoroplastics, in particular, pure PFA used to produce the inner shell and that part of the stopper device which is intended to penetrate into the inner shell.

According to another characteristic of the present invention, the inner shell made of PFA by rotomoulding, or rolling or thermoforming then welding of sheets of PFA, is reinforced with composite materials, for example polyester and glass fibres, making it possible to produce an inner shell which is resistant to pressure.

The inner shell preferably exhibits domed upper and lower parts joined together by a cylindrical part, this cylindrical part being located at a certain distance internally from the inner wall of the outer shell.

In order to assemble the container, fixing members made of composite, non-metallic, materials are used, such as the studs already mentioned above for assembling the stopper device on the collar of the inner shell and screws for fixing the lid on the one hand to the inner shell and on the other hand to the outer shell.

The container is thus entirely demountable so that, after removal of the lid and of a dust cap which is generally provided above the stopper device, the inner shell may easily be extracted from the outer shell and, if need be, replaced.

BRIEF DESCRIPTION OF THE DRAWINGS

For the purpose of making the invention easier to understand, one embodiment thereof will now be described by way of non-limiting example, with reference to the appended drawing in which.

DETAILED DESCRIPTION OF THE INVENTION

Figure 2:
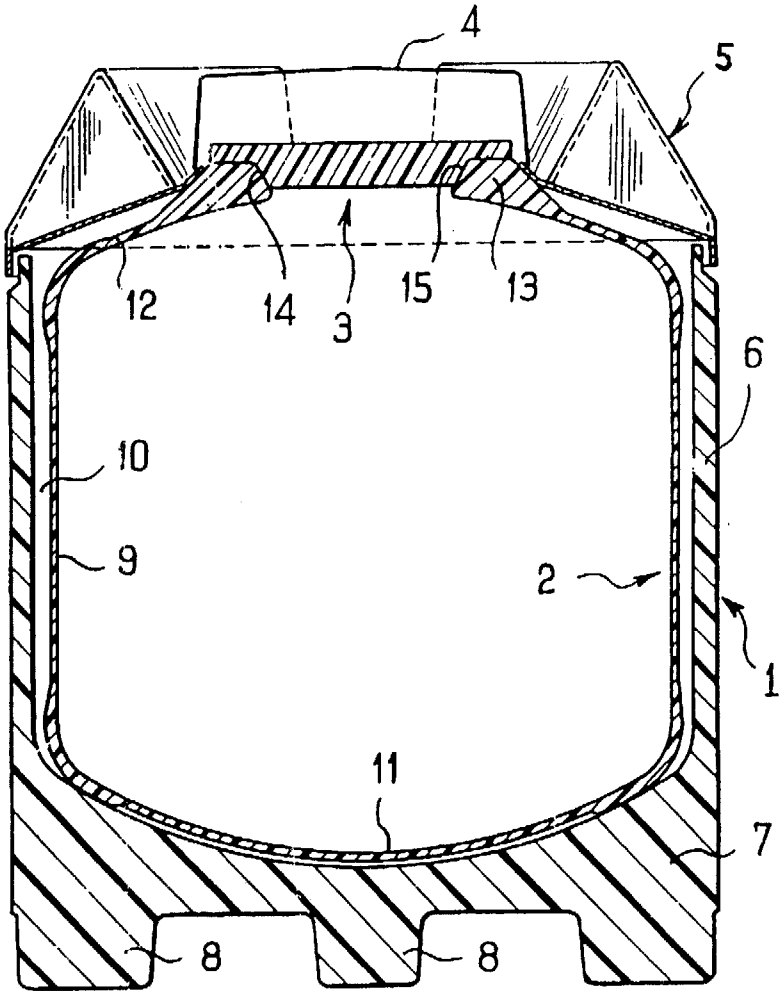
FIG. 2 is a very diagrammatic sectional view of the container of FIG. 1.

The container represented in the drawing includes an outer shell denoted overall by 1, an inner shell denoted overall by 2, a stopper device denoted overall by 3 and fitted with connections (not represented) for the introduction and distribution of chemical products to and respectively from the cavity formed by the inner shell 2, a dust cap 4 covering the connections projecting upwards from the stopper device 3, during transport and storage, and an annular upper lid denoted overall by 5 mounted at the upper end of the outer shell 1.

The outer shell 1 includes a cylindrical part 6 formed integrally with a rectangular base 7 fitted with feet 8.

The outer shell 1 formed of the cylindrical part 6 and of the base 7 is, preferably, made up of a double-walled structure, particularly made of polyethylene filled with a foam, preferably polyurethane.

Owing to its shape and dimensions, the base 7 constitutes a structure which overhangs slightly with respect to the cylindrical part 6 and constitutes protection against any lateral impacts.

The base also contributes to the very good stability of the container on the ground and may act as a pallet during transport and storage.

The inner shell 2, produced for example from PFA reinforced with composite materials, includes a cylindrical part 9 located concentrically with the cylindrical part 6 of the outer shell 1 with a radial spacing 10, the said cylindrical part 9 extending downwards in the form of a domed part 11 and upwards in the form of a part 12, also domed, ending in a collar 13 defining the opening giving access to the volume inside the inner shell.

As seen in FIG. 2, the inner wall 14 of the collar 13 defining the opening giving access to the inside of the inner shell 2 exhibits a frustoconical shape converging towards the inside of the said shell.

The stopper device 3, in the form of a disc, at its lower part includes a frustoconical bearing surface 15, the shape of which corresponds to the frustoconical bearing surface 14 of the collar 13 allowing mounting and forcible retention of the stopper device 3 on the collar 13.

The stopper device 3 is fitted, in a conventional manner, with connections (not represented) extending downwards and upwards from the device as illustrated.

The stopper device may be produced from a composite material and coated, at least on its part facing the volume inside the inner shell, with a sheet of thermoformed chemically inert material, particularly PFA, it being possible for the upper part of the stopper device also to be coated with a sheet of PFA or of polyethylene.

Figure 1:
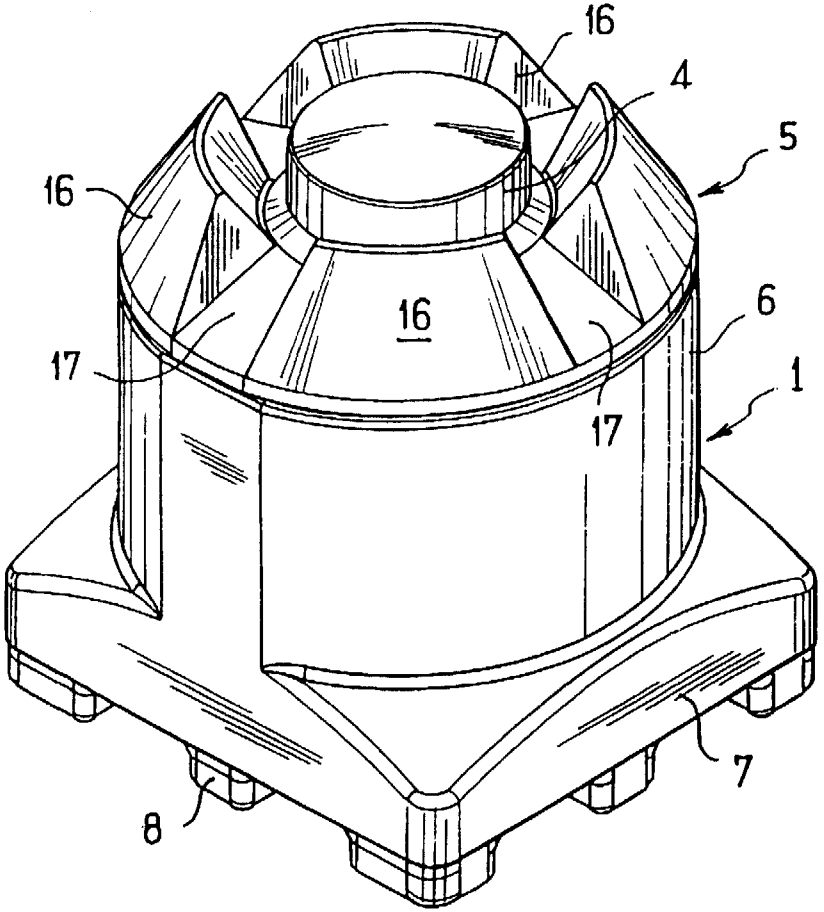
FIG. 1 illustrates a container according to the invention in the assembled position.

The annular lid 5 fitted at the upper end of the cylindrical part 6 of the outer shell 1 exhibits, as is best seen in FIG. 1, the shape of a ring cut from a cone frustum, this ring itself being truncated along radii in order to define bosses 16 separated by slits 17 each including a base wall inclined downwards and outwards.

The maximum height of the bosses 16 of the lid is at least equal to the height of the parts of the connections made through the stopper device 3 and extending upwards from the latter.

The stopper device 3 is assembled to the collar 13 by non-metallic fixing members, particularly ones made of composite material, and in the same manner, non-metallic fixing elements are provided for fixing the lid to the inner shell on the one hand and to the outer shell on the other hand.

In practice, the junctions of-the lid with the outer shell and the collar of the inner shell are closed by seals of the ring type in order to plug any gap which might remain between the assembled components and thus prevent any retention of chemical product in such gaps.

The present invention thus makes it possible to produce a pressurizable container which is entirely demountable, has no metallic components, is resistant to attack by the chemical products transported and offers excellent resistance to impacts, throughout the phases of transport, storage and distribution.

We claim:

1. A free standing container for transporting, storing, and dispensing chemical products, including an inner shell made of fluorinated plastic, particularly PFA, fitted at its upper pan with a stopper device (3) penetrated by filling and dispensing connections, and an outer shell (1) having a generally cylindrical outer shape and an inner shape generally congruent with that of the inner shell, characterized in that the outer shell (1) comprises an upper cylindrical part (6) which is integrally joined at its bottom portions with a base (7), said base having a quadrilateral shape and said base being of greater cross-sectional area than that of the cylindrical part of the outer shell, said base (7) having lateral portions projecting outwardly beyond the upper cylindrical portions of said outer shell and thereby providing protection against impacts from the side as well as stability of the free-standing container, said outer shell cylindrical part and base being integral, one piece, molded construction.

2. Container according to claim 1, characterized by the fact that the said base (7) exhibits a rectangular shape.

3. Container according to claim 1 characterized by the fact that the said base (7) has feet (8) at its lower part.

4. Container according to claim 1 characterized by the fact that the outer shell (1) is surmounted by an annular lid (5), the said lid being made up of a plurality of bosses (16) separated from each other by slits (17) with a bottom wall inclined downwards and outwards.

5. Container according to claim 4, characterized by the fact that the annular lid (5) exhibits a frustoconical overall shape, the bosses (16) being segments of a cone frustum.

6. Container according to claim 1, characterized by the fact that the stopper device (3) is fixed to a collar (13) provided at the upper part of the inner shell (2) and exhibits a frustoconical lower extension (15) capable of being housed in the said collar which for this purpose includes an inner wall (14) of corresponding frustoconical shape.

7. Container according to claim 1, characterized by the fact that the inner shell (2) exhibits a cylindrical part (9) and domed lower and upper parts (12), the said cylindrical part (9) being located radially away from the cylindrical part (6) of the outer shell (1).

8. Container according to claim 1, characterized by the fact that the inner shell (2) is reinforced with composite materials, particularly polyester and glass fibres.

* * * * *